US007231792B2

(12) United States Patent
Shitamoto et al.

(10) Patent No.: US 7,231,792 B2
(45) Date of Patent: Jun. 19, 2007

(54) METHOD AND DEVICE FOR MANUFACTURING UOE STEEL PIPES

(75) Inventors: Hidenori Shitamoto, Hyogo (JP); Tetsuya Fukuba, Ibaraki (JP); Yoshimasa Matsumoto, Ibaraki (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 0 days.

(21) Appl. No.: 11/473,045

(22) Filed: Jun. 23, 2006

(65) Prior Publication Data

US 2006/0236737 A1 Oct. 26, 2006

Related U.S. Application Data

(63) Continuation of application No. PCT/JP2004/019308, filed on Dec. 24, 2004.

(30) Foreign Application Priority Data

Dec. 25, 2003 (JP) ..... 2003-429729

(51) Int. Cl.
*B21D 51/28* (2006.01)
*B21C 37/06* (2006.01)

(52) U.S. Cl. ..... 72/51; 72/52; 72/368

(58) Field of Classification Search ..... 72/51, 72/52, 176, 133, 368, 702; 228/151
See application file for complete search history.

(56) References Cited

U.S. PATENT DOCUMENTS 672,689 A * 4/1901 Whitehouse ..... 72/52
4,148,426 A * 4/1979 Midzutani et al. ..... 228/146
4,460,118 A * 7/1984 Ataka et al. ..... 228/146
5,301,869 A * 4/1994 Toyooka et al. ..... 228/147

FOREIGN PATENT DOCUMENTS

| | | |
|---|---|---|
| JP | 54-062161 | 5/1979 |
| JP | 59-202122 | 11/1984 |
| JP | 59-232620 | 12/1984 |

* cited by examiner

*Primary Examiner*—Lowell A. Larson
*Assistant Examiner*—Teresa M. Bonk
(74) *Attorney, Agent, or Firm*—Clark & Brody

(57) ABSTRACT

A method and device for manufacturing UOE steel pipes, wherein, when an opening width of the U-can obtained by U-ing press is larger than the die-diameter in an O-press of later step, while said opening is narrowed from the front end by the closing rolls disposed before said O-press and/or at least at the entrance portion of the O-press to be smaller than the die-diameter of said O-press, the U-can is simultaneously conveyed into the O-press, and then, after charging into the O-press, undergoes O-ing press to yield an O-can. The device is preferably configured to have the closing rolls disposed in a roll stand and consisted of multiple pairs, to have a mechanism to prevent the U-can from moving upward during narrowing the opening width, and to have the function of conveying the U-can. Thus, UOE steel pipes for high-strength application corresponding to X80 grade can be efficiently manufactured.

12 Claims, 7 Drawing Sheets

METHOD AND DEVICE FOR MANUFACTURING UOE STEEL PIPES

"CROSS REFERENCE TO RELATED APPLICATIONS

This application is a continuation of International Patent Application No. PCT/JP2004/019308, filed Dec. 24, 2004. This PCT application was not in English as published under PCT Article 21(2)."

BACKGROUND OF THE INVENTION

1. Field of the Invention

The present invention relates to a method and device for manufacturing UOE steel pipes, and more particularly to a method and device for manufacturing UOE steel pipes employing material, which exhibits a large springback after U-ing press, as a starting blank plate in association with a growing demand for increasing strength of steel pipes to be used.

2. Description of the Related Art

Conventionally, in manufacturing a large-diameter pipe, a method for manufacturing UOE steel pipes has been widely applied, wherein the manufacturing steps consist of "Crimping press"—"U-ing press"—"O-ing press"—"Internal/external welding"—"Expansion" in general.

FIG. 1 is a diagram explaining how a starting blank plate is deformed in "Crimping press", "U-ing press" and O-ing press" among the overall manufacturing steps for UOE steel pipes. Firstly, in Crimping press, both width-wise edge parts of a starting blank plate (a heavy plate) are subjected to bending deformation to roughly match the outside diameter of the final steel pipe, in order to reduce a required working load in O-ing press as well as to prevent the generation of peaking phenomenon in O-ing press.

Next, in U-ing press, by employing a U-press having an open die, the flat plate formed by C-press is deformed into a U-like shape to yield a U-can 1 which can be conveyed to a unit of O-press. And then, in O-ing press, the U-can 1 thus conveyed is deformed into an O-like shape by employing an O-press having a closed die.

As shown in FIG. 1, subsequent to a series of "Crimping press", "U-ing press" and O-ing press", an internal & external welding is applied to make a primary steel pipe which does not satisfies the required dimensional accuracy in terms of the diameter and out-of-roundness. In this regard, the primary pipe is further expanded, so-called enlarging its bore in cold working condition, not only to correct the size of the primary steel pipe but also to reduce the internal tensile stress incurred by press forming as well as welding and to generate an internal compressive stress.

Meanwhile, for steel pipes for use in line pipe where UOE steel pipes are mostly adopted, the demand for high-strength line pipe capable of withstanding the high pressure-transportation is becoming high from the view point of enhancing the transportation efficiency of crude oil, natural gas or the like being obtained in oil and/or gas wells. For example, in association with increasing strength of steel pipes, it becomes possible to reduce the thickness of steel pipes to be laid, thus enabling costs for transportation and/or laying of steel pipes to be reduced.

At present, as steel pipes for use in line pipe, X42–X80 grades are specified in API (American Petroleum Institute) Standard. However, UOE steel pipes that are put into practice in line pipes remain to be made of X70 grade at most. Steel pipes of X80 grade are rarely used in actual line pipe, and only a few cases in actual application are reported thus far. This is attributed to the facts that, in making steel pipes having high-strength of X80 grade or more, it is very difficult to meet the required allowable yield-strength ratio, that is specified for X80 grade in API Standard, for example 93% or less, and press forming cannot be easily carried out.

In particular, as regards press formability, in association with increasing strength of material, the springback after U-ing press in UOE steel pipes becomes large, which leads up to cause a large opening width in the U-can. In the explanation hereinafter, an opening width of the U-can after U-ing press is simply referred to as "U-can width".

FIGS. 2A and 2B are diagrams showing the relationship between the incidence of U-can width along with the U-can width itself and the die-diameter. Herein, the U-can width W is defined to represent a maximum opening width of the U-can 1. As shown in FIG. 2A, when the U-can width W is larger than the die-diameter of O-press 7, it is not possible to convey the U-can 1 to the proper position within the unit of the O-press 7 due to the interference with the dies 8. Therefore, as shown in FIG. 2B, U-ing press is repeated for plural times until the U-can width W should become smaller than the die-diameter of O-press 7, and then the U-can 1 has to be conveyed to the proper position within the unit of the O-press 7.

However, in a process applying a plurality of U-ing so that the U-can can be conveyed to the next step, it takes much longer time to perform U-ing press, thus resulting in the notable decrease in productivity. Further, since work hardening becomes eminent in the bottom part of the U-can as well as in the vicinity thereof subjected to plastic deformation in the plural U-ing process, the strength distribution in the circumferential direction after pipe making becomes uneven, and the yield-strength ratio of steel pipe also rises.

In order to reduce the U-can width after U-ing press, as shown in FIGS. 3A and 3B, in performing U-ing press by employing a punch 9 and a die 10 for U-press, a larger punch stroke of U-press than an ordinary punch stroke is occasionally applied for forming operation. FIG. 3A denotes the deformation in the case of the ordinary punch stroke, while FIG. 3B denotes the deformation in the case of the large punch stroke.

FIGS. 4A and 4B are diagrams showing the incidence of the U-can width after U-ing press in terms of the difference of the punch stroke. FIG. 4A denotes the incidence of the U-can width Wa in the case of the ordinary punch stroke in forming operation, while FIG. 4B denotes the incidence of the U-can width Wb in the case of the larger punch stroke in forming operation.

By applying a large punch stroke in a forming operation, it becomes possible for the U-can width Wb after U-ing press to be reduced. However, as the shape after forming becomes the configuration shown in FIG. 4B, it is likely that the out-of-roundness of steel pipes as end products becomes worse and the buckling of the U-can 1 during O-ing press may occur.

Meanwhile, as regards a means for conveying the U-can after U-ing press to the proper position within the unit of O-press, there is disclosed a method for conveying the U-can while preventing it from tilting by disposing a closing stand between the U-press and O-press units in Japanese Patent Publication No. 59-232620. However, the role of the side roll provided at said stand in the foregoing Japanese Patent Publication No. 59-232620 is merely to help conveying the U-can to the proper position within the unit of O-press. Thus, this cannot cope with the incidence of the U-can width in association with increasing strength of UOE steel pipes.

SUMMARY OF THE INVENTION

The present invention is made to solve the problem encountered in association with the foregoing demand for high-strength line pipes, and its object is to provide a method and device for manufacturing UOE steel pipes to be applied in the production of high-strength UOE steel pipes, for example in the production of UOE steel pipes of X80 grade specified in API Standard, wherein the resultant U-can width after U-ing press is improved so that the U-can can be efficiently conveyed to the proper position within the unit of O-press.

To solve the foregoing problem, the present inventors made various research works in relation to the method for manufacturing high-strength UOE steel pipes, and took note of the function and effects of closing rolls disposed at the later step than U-ing press. Eventually, it is made clear that it is effective for this closing rolls to be configured to have the function of squeezing the U-can as well as the function of conveying the U-can.

To be concrete, in the production of UOE steel pipes, a pair or a plural pairs of closing rolls are disposed where each roll of the pair is as opposed to each other to squeeze and convey the U-can simultaneously. Further, the squeezing position of closing rolls is set to the suitable height according to the size of steel pipes.

In squeezing the U-can, the work stroke of closing rolls is adjusted to squeeze the predetermined position of the U-can so that the U-can width of the pipe end on the side near the O-press becomes narrower than the die-diameter in the unit of O-press. Then after, the closing rolls, together with conveyor rolls disposed at the beneath of the bottom part of the U-can, are activated to rotate so as to convey the U-can to the proper position within the unit of the O-press in the next step.

Further, depending upon the squeezing position by the squeeze rolls and the extent of the initial U-can width, there should occur the occasion that the length-wise pipe end of the U-can moves upward, so that a retarding roll is provided to retard the U-can from the above so as not to move upward.

The U-can width after U-ing press depends upon the size of steel pipes such as the outside diameter and wall thickness as well as upon the material strength, which inevitably affects the required stroke in squeezing by the squeeze rolls so that the U-can width at its length-wise end on the side near the O-press is reduced to the predetermined value. Hence, the amount of squeezing is examined for representative sizes of steel pipes as well as for the representative material strength.

FIG. 5 is a diagram showing the layout of the closing rolls that are employed in the precise investigation. Two pairs of closing rolls 3 are disposed in the roll stand 6, whereas an O-press is disposed on the side designated by the symbol A and the U-can 1 is conveyed by the conveyor rolls 2. The yield strength of the material to be used is set to two levels like 700 N/mm$^2$ and 750 N/mm$^2$. The length of the U-can is set to 12 m, and the size of the finished pipe is set to 24 inch and 28 inch in diameter in combination with 12 mm and 14 mm in wall thickness. Further, the symbol L in the diagram is set to 3 m, and the height H of squeezing position is set to 700 mm.

The height (H: 700 mm) of two pairs of closing rolls 3 that are disposed in the rolling stand 6 is adjusted, and also, the position of the retarding rolls 4 is tuned to fit in the operation according to the size of steel pipes to be made. The U-can width on the side A in said FIG. 5 is squeezed so as to reach the ratio of 0.95 with respect to the die-diameter of O-press, whereas the stroke of the closing rolls 3 required for squeezing is measured. Now, what is measured is the stroke defined by the distance (one-side value: mm) from the startup of the contact between the closing rolls and the U-can to the position where the U-can width at the its length-wise end on the side A reaches the predetermined value.

Table 1 shows one example of the results of the measured stroke in the above investigation.

[Table 1]

TABLE 1

| Size of Steel Pipes Outside Diameter (inch) × Wall Thickness (mm) | Yield Strength 700 (N/mm$^2$) | Yield Strength 750 (N/mm$^2$) |
|---|---|---|
| 24 × 12 | 175 mm | 200 mm |
| 24 × 14 | 150 mm | 180 mm |
| 28 × 12 | 190 mm | 220 mm |
| 28 × 14 | 160 mm | 195 mm |

As regards the size of steel pipes that are not measured, the required stroke for the closing rolls can be estimated from the obtained stroke readings by the measurement. Further, in case that high-strength steel pipes are made, a relatively large springback after U-ing press is foreseen, so that it becomes necessary to reconsider appropriate parameters such as the distance L and the position of the retarding rolls in FIG. 5.

The present invention is made based on the foregoing findings, and the gist thereof pertains to the method for manufacturing UOE steel pipes, which is described in (1) through (3) as below, and to the device for manufacturing UOE steel pipes, which is described in (4) through (7) as below.

(1) A method for manufacturing UOE steel pipes, wherein, after forming a U-can by a U-press and in case that an opening width of the obtained U-can is larger than the die-diameter of the O-press in the later step, while the opening width thereof is narrowed incrementally from the front end of said U-can by the closing rolls, that are disposed in the step prior to said O-press, so as to be smaller than the die-diameter of said O-press, the U-can is simultaneously conveyed into the O-press, and then, after completion of charging into the O-press, is subjected to O-ing press to yield an O-can.

(2) A method for manufacturing UOE steel pipes, wherein, after forming a U-can by a U-press and in case that an opening width of the obtained U-can is larger than the die-diameter of an O-press in the later step, while the opening width thereof is narrowed incrementally from the front end of said U-can by the closing rolls, that are disposed at least at the entrance portion of said O-press, so as to be smaller than the die-diameter of said O-press, the U-can is simultaneously conveyed into the proper position within the O-press, and then, after completion of charging into the O-press, is subjected to O-ing press to yield an O-can.

(3) A method for manufacturing UOE steel pipes, wherein, after forming a U-can by a U-press and in case that an opening width of the obtained U-can is larger than the die-diameter of an O-press in the later step, while the opening width thereof is narrowed incrementally from the front end of said U-can by the closing rolls, that are disposed in the step prior to said O-press, so as to be smaller than the die-diameter of said O-press, the U-can is simultaneously conveyed into the O-press, and wherein, further, while the opening width thereof is narrowed incrementally from the front end of said U-can by the closing rolls, that are disposed at least at the entrance portion of said O-press, so as to be smaller than the die-diameter of said O-press, the U-can is simultaneously conveyed into the proper position within the O-press, and then, after completion of charging into the O-press, is subjected to O-ing press to yield an O-can.

(4) A device for manufacturing UOE steel pipes for use in the manufacturing method described in the above (1), comprising a U-press for forming a U-can, closing rolls disposed in the step prior to an O-press for narrowing an opening width of said U-can to be smaller than the die-diameter of said O-press, and an O-press for containing and O-ing the U-can whose opening width is narrowed over its entire length to yield an O-can.

(5) A device for manufacturing UOE steel pipes for use in the manufacturing method described in the above (2), comprising a U-press for forming a U-can, closing rolls disposed at least at the entrance portion of said O-press for narrowing an opening width of said U-can to be smaller than the die-diameter of said O-press, and an O-press for containing and O-ing the U-can whose opening width is narrowed over its entire length to yield an O-can.

(6) A device for manufacturing UOE steel pipes for use in the manufacturing method described in the above (3), comprising a U-press for forming a U-can, closing rolls disposed in the step prior to said O-press as well as at least at the entrance portion thereof for narrowing the opening width of said U-can to be smaller than the die-diameter of said O-press, and an O-press for containing and O-ing the U-can whose opening width is narrowed over its entire length to yield an O-can.

(7) In any device described in the above (4) through (6), it is preferable that the closing rolls are disposed in the roll stand and configured to comprise multiple pairs. Further, it is preferable that the device comprises the mechanism to prevent the U-can from moving upward when the closing rolls are narrowing the opening width thereof and has the function of conveying the U-can.

The reason for specifying "closing rolls disposed at least at the entrance portion of an O-press" in the present invention is to prepare for the foreseen case that, since the U-can width after U-ing press should vary notably depending on the size of steel pipes such as the outside diameter and wall thickness as well as on the material strength, there should be the occasion that closing rolls need not be disposed over the entire span of the O-press, in case that said closing rolls are to be disposed within the unit of O-press, so that it might be sufficient to employ closing rolls only disposed at the entrance portion of the O-press according to the extent of the U-can width.

According to the method and device for manufacturing UOE steel pipes by the present invention, even if the UOE steel pipes corresponding to X80 grade specified in API Standard should be manufactured, the U-can width being generated after U-ing press can be improved so that the U-can is conveyed into the proper position within the unit of O-press without interfering with the dies thereof, thus enabling UOE steel pipes of high-strength to be manufactured efficiently. Hence, it becomes possible to adequately cope with the demand for high-strength line pipes, thereby enabling to manufacture UOE steel pipes of high-strength for a variety of wall thickness and outside diameter.

DETAILED DESCRIPTION OF THE PREFERRED EMBODIMENTS

Hereinafter, the subject matter and effects of the present invention are recited in details on the basis of the concrete examples shown in FIGS. 6–14.

Figure 1:
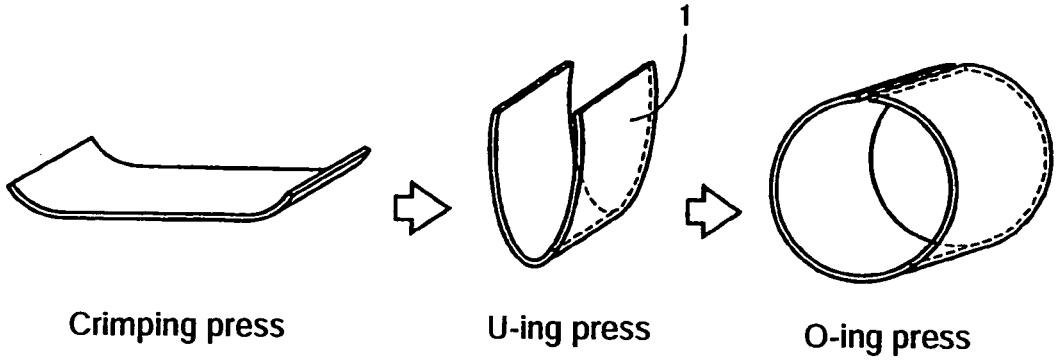
FIG. 1 is a diagram explaining how the plate material is processed in "Crimping press", "U-ing press", and "O-ing press" among the manufacturing steps of UOE steel pipes.
Figure 2A:
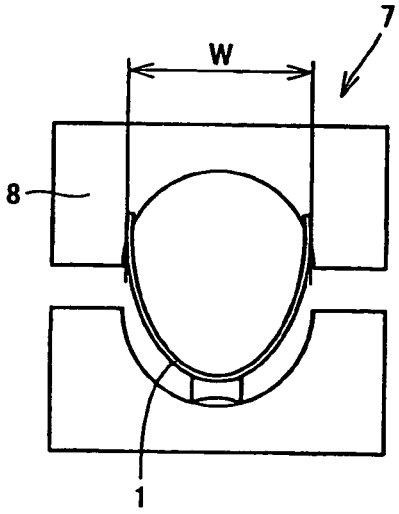
FIGS. 2A and 2B are diagramd showing an incidence of a U-can width and the relationship between said U-can width and the die-diameter of O-press.
Figure 2B:
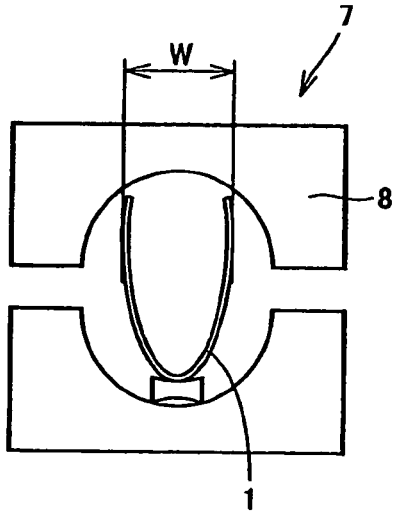
Figure 3A:
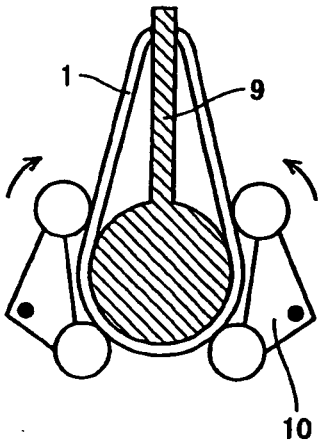
FIGS. 3A and 3B are diagrams explaining how a U-can is formed by a U-press.
Figure 3B:
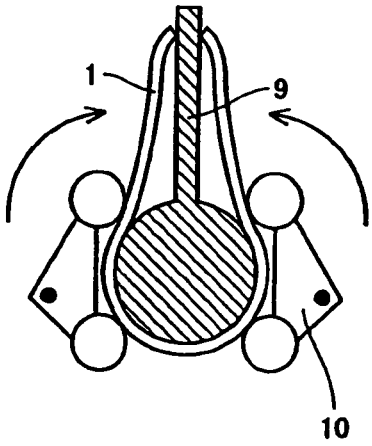
Figure 4A:
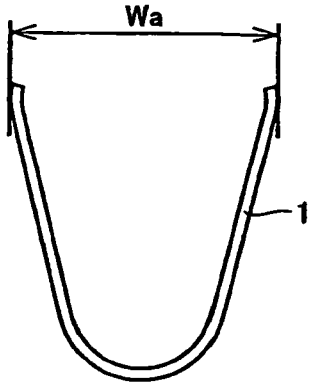
FIGS. 4A and 4B are diagrams showing how an incidence of a U-can width after U-ing press is affected by the difference of a punch stroke.
Figure 4B:
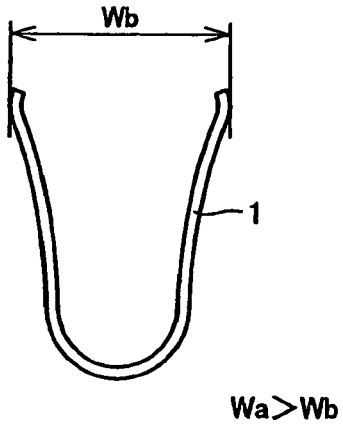
Figure 5:
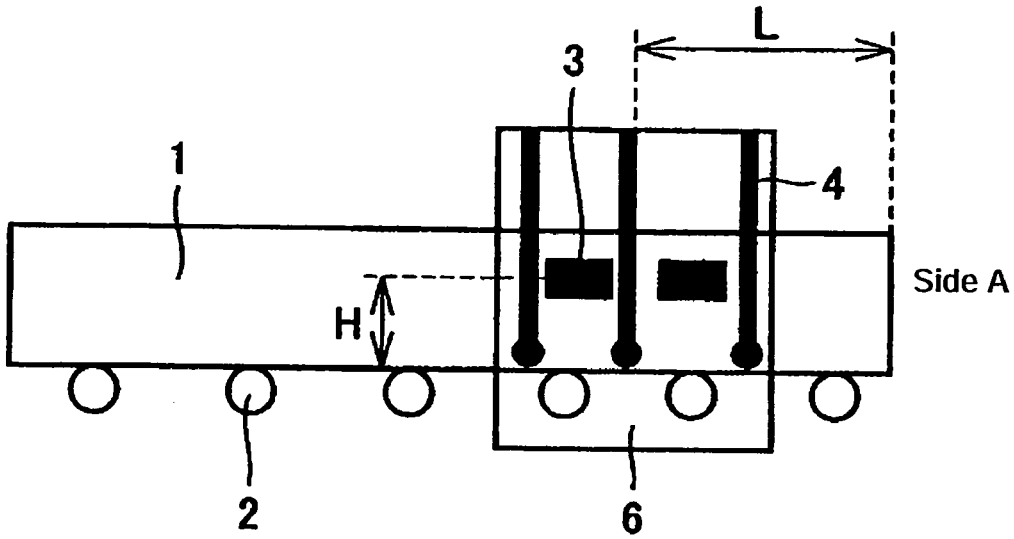
FIG. 5 is a diagram showing the layout of closing rolls that are used in the precise investigation.
Figure 6:
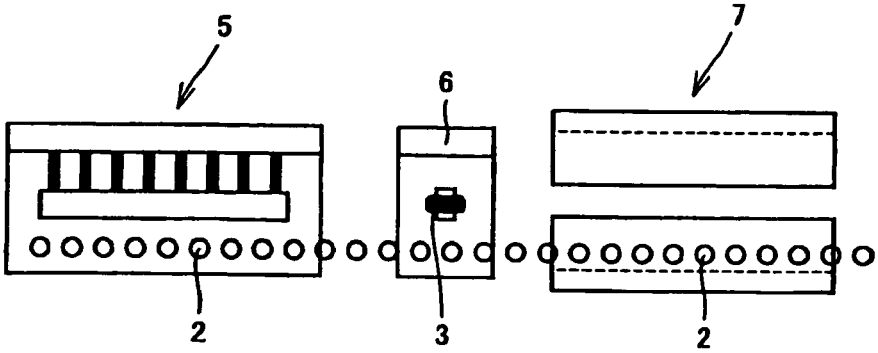
FIG. 6 is a diagram showing an example of the layout of units being employed in the manufacturing steps of UOE steel pipes according to the present invention.

FIG. 6 is a diagram showing an example of the layout of units being employed in the manufacturing steps of UOE steel pipes according to the present invention. In the example of the unit layout shown in FIG. 6, the closing rolls 3 are disposed in the roll stand 6 being located at the step subsequent to forming by a U-press 5 but prior to an O-press 7. However, the present invention is not limited to this unit layout, and it could be such that the closing rolls 3 can be disposed within the main body of the O-press 7, otherwise both at the step prior to the O-press and within the main body of the O-press. Further, the path-line from the U-press 5 to roll stand 6 to O-press 7 is connected by a series of conveyor rolls 2.

Figure 7A:
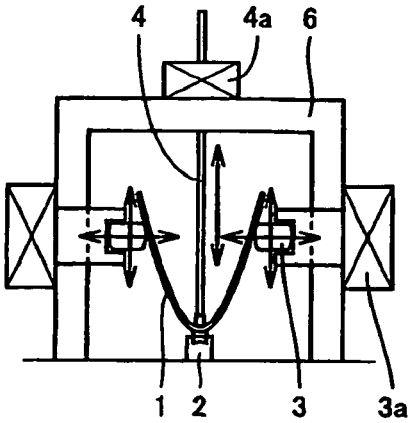
FIGS. 7A and 7B are diagrams showing the configuration of closing rolls disposed in the roll stand, whereas 7A is an elevated view, and whereas 7B is a plan view.
Figure 7B:
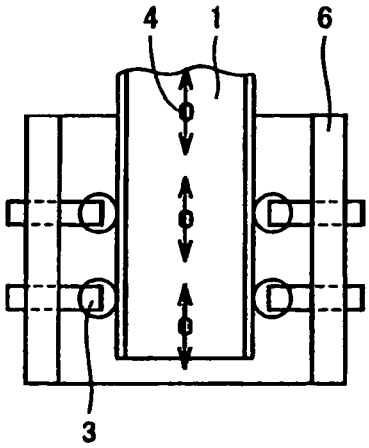

FIGS. 7A and 7B are diagrams showing the configuration of closing rolls disposed in the roll stand, whereas 7A is an elevated view, and whereas 7B is a plan view. The closing rolls 3 consist of two pairs and are configured to be movable vertically in addition to the squeezing movement (horizontal direction) so as to enable the squeezing position to be adjusted according to the size of steel pipes.

Further, the closing rolls 3 can be rotated by the driving motors 3*a*, so that it becomes possible for the U-can 1 after being squeezed to be conveyed by activating them to rotate. Also, at the upper part of the roll stand 6, there are disposed of three sets of retarding rolls 4, each set of which can be mobilized by the driving motors 4*a* both in the vertical and longitudinal directions.

Figure 8A:
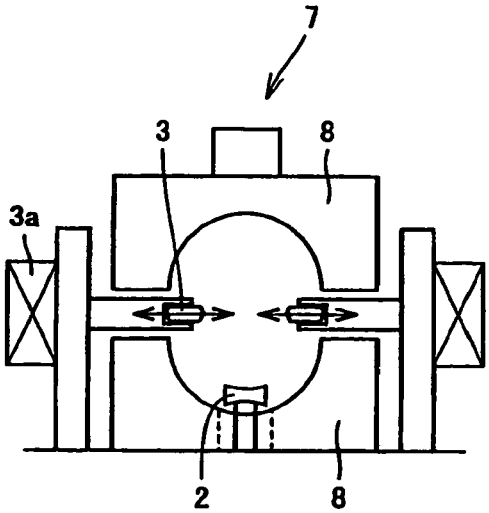
FIGS. 8A and 8B are diagrams showing the configuration of the unit of O-press, whereas 8A is an elevated view, and whereas 3B is a plan view.
Figure 8B:
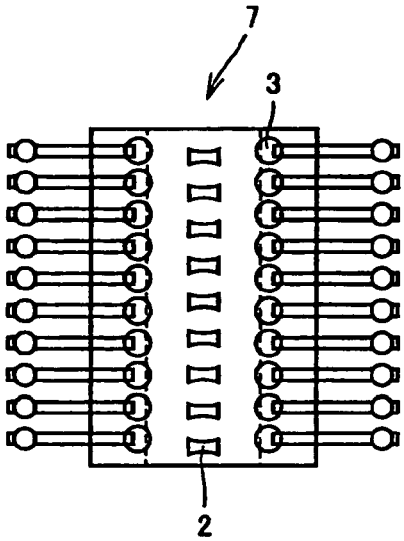

FIGS. 8A and 8B are diagrams showing the configuration of the unit of O-press, whereas 8A is an elevated view, and whereas 8B is a plan view. The unit of O-press comprises ten sets of guide rolls that can be given the function of closing rolls, thereby enabling them to be utilized as the closing rolls 3. Namely, the guide rolls shown in FIGS. 8A and 8B can move in the squeezing direction (horizontal direction) to squeeze the U-can while being conveyed into the proper position within the unit of O-press, and also can be rotated by the driving motors 3*a,* which makes it possible to convey the U-can, after completion of squeezing, by activating them to rotate.

As aforementioned, the U-can width after U-ing press should vary notably depending on the size of steel pipes such as the outside diameter and wall thickness as well as on the material strength. Accordingly, in the case that the guide rolls being disposed at the main body of the O-press be used as the closing rolls, it is not always necessary to employ all of them over the entire length of the main body of the O-press, so that, according to the extent of the U-can width, the closing rolls disposed at the entrance portion of the O-press could be used to narrow the U-can width to be smaller than the die-diameter of the O-press and to convey the U-can into the O-press and set it in place. Such being the case, in the case that the closing rolls are disposed at the main body of the O-press, the present invention specifies to dispose the closing rolls at least at the entrance portion thereof.

At the bottom part of the die 8 of the unit of O-press, there is provided an opening segment for conveyor rolls in which the conveyor rolls 2 are disposed. The conveyor rolls 2 can rotate by the driving motors. Further, the conveyor rolls adopt an air-cushion suspension system so that, if the excessive work load beyond the predetermined value should be exerted during U-ing press, the conveyor rolls are structurally configured to move down below the die bottom surface.

Figure 9:
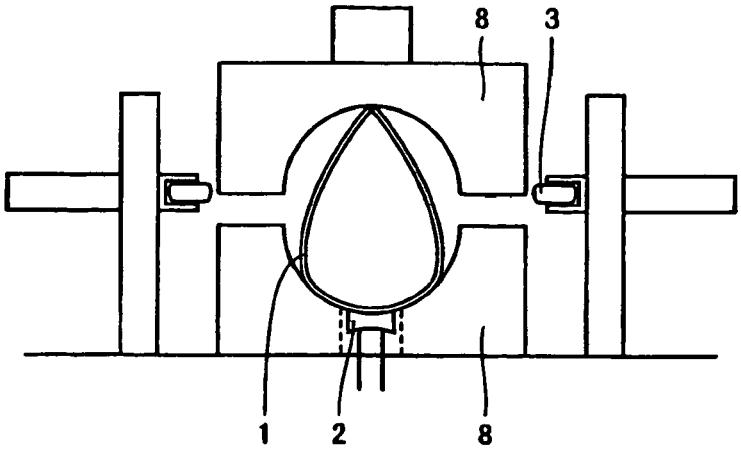
FIG. 9 is a diagram showing the configuration how the U-can, being completely charged into the O-press, is deformed by the unit of O-press.

FIG. 9 is a diagram showing the configuration how the U-can, being completely charged into the proper position within the unit of O-press, is formed by the unit of O-press. As shown in FIG. 9, when the U-can 1 after completion of charging of the U-can 1 is ready to be formed by the O-press, all of closing rolls 3 or guide rolls are retreated from the space confined by the upper and lower dies 8, and all of the conveyor rolls 2 are moved down below the die bottom surface. Thus, the O-ing press becomes possible.

Next, the procedure for narrowing the U-can width by squeezing the U-can 1 by means of the closing rolls 3 being disposed in the roll stand 6 shown in the above FIGS. 7A and 7B as well as by means of the unit of O-press 7 having the closing rolls 3 in place as shown in the above FIGS. 8A, 8B and 9 is recited concretely. The U-can 1 after U-ing press ought to be conveyed, by activating the conveyor rolls 2, into the roll stand 6 in which the closing rolls 3 are disposed. In this occasion, in case that the U-can width is larger than the die-diameter of the O-press, it becomes necessary to perform the squeezing operation as to the U-can 1.

Figure 10A:
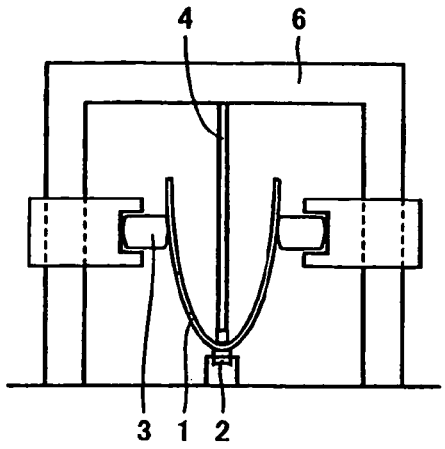
FIGS. 10A and 10B are diagrams showing the state that the U-can is squeezed by closing rolls disposed in the step prior to the O-press, whereas 10A is an elevated view, and whereas 10B is a plan view.
Figure 10B:
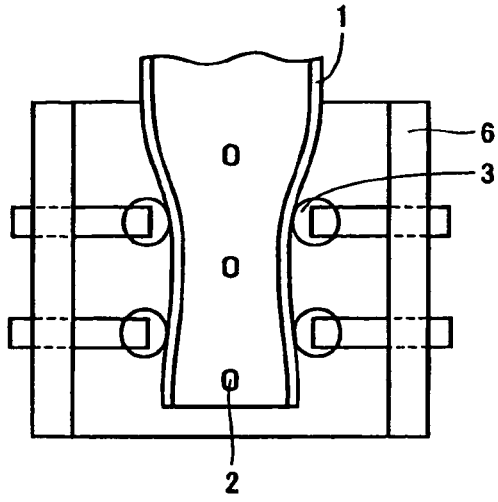

FIGS. 10A and 10B are diagrams showing the state that the U-can is squeezed by closing rolls disposed at the step prior to the O-press, whereas 10A is an elevated view, and whereas 10B is a plan view. The closing rolls 3 are mobilized in the squeezing direction (horizontal direction) until the U-can width at its length-wise end on the exit side of the rolling stand 6 comes to be smaller than the die-diameter of the O-press to complete squeezing the U-can 1. In this occasion, the squeezing position by the closing rolls 3 is properly adjusted according to the size of steel pipes.

Incidentally, in such an occasion that the initial U-can width is significantly larger than the die-diameter, both length-wise ends of the U-can happen to move upward. If the part getting in contact with the conveyor rolls 2 should move upward, the function to convey the U-can 1 should be abated, so that the retarding rolls 4 (three sets shown in the diagram) disposed in the roll stand 6 function to prevent the U-can 1 from moving upward. At this time, the layout of these retarding rolls 4 is properly adjusted according to the size of steel pipes.

Then, by rotating the closing rolls 3 in contact with the U-can 1 at the squeezing position as well as the conveyor rolls 2 in contact with the U-can 1 at the bottom portion thereof, the U-can 1 is conveyed into the O-press.

Figure 11:
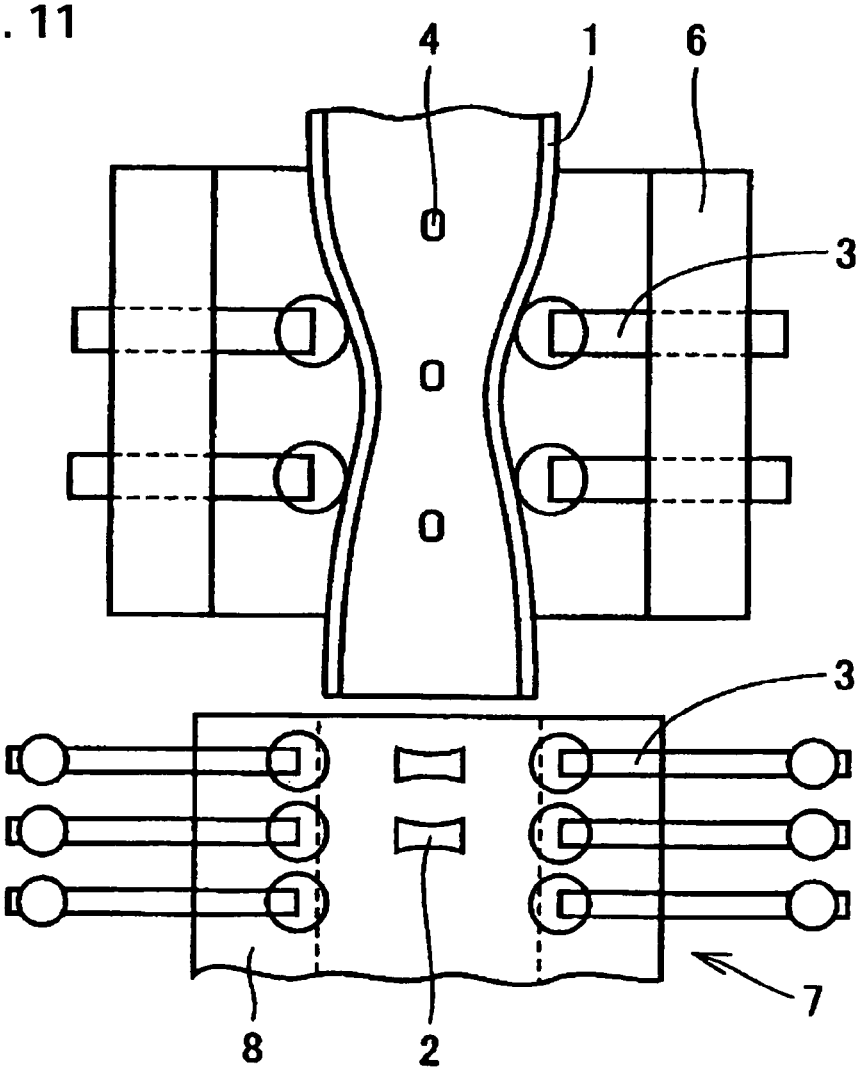
FIG. 11 is a plan view of the configuration of the roll stand and the unit of O-press just before the U-can is conveyed into the proper position within the unit of O-press.

FIG. 11 is a plan view of the configuration of the roll stand and the unit of O-press just before the U-can is conveyed into the proper position of the unit of O-press. In the course of conveying the U-can 1 while being squeezed by the closing rolls 3 that are disposed in the roll stand 6, the U-can width at the front end portion becomes larger than in the initial squeezing state due to the springback. If the conveying operation should continue like this, the U-can width at the front portion should become larger than the die-diameter of the O-press 7 to bump into the dies 8 to give damage on the dies 8, thus making it impossible to convey the U-can 1.

Figure 12:
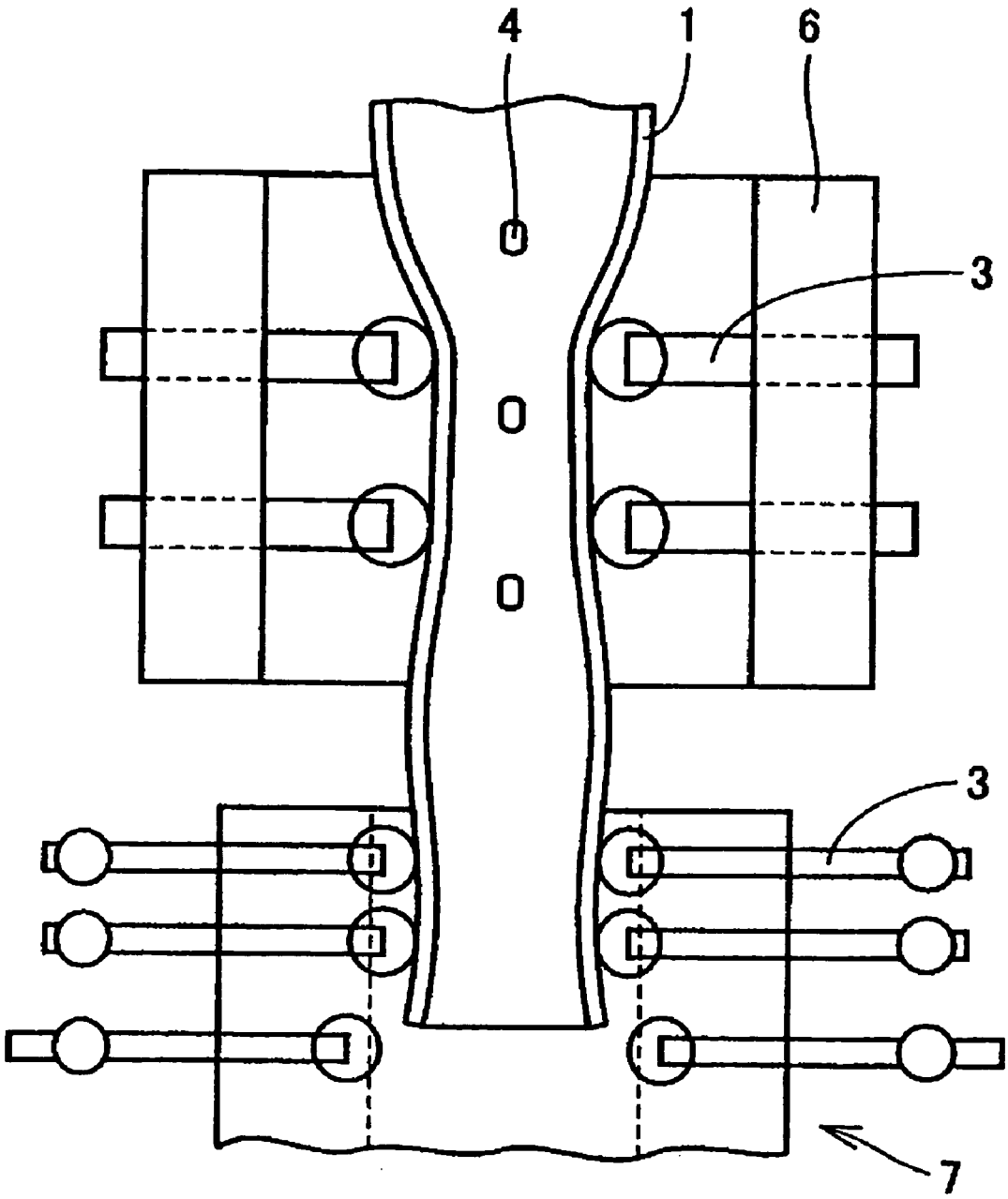
FIG. 12 is a plan view of the configuration of the roll stand and the unit of O-press after the U-can is conveyed into the proper position within the unit of O-press.

FIG. 12 is a plan view of the configuration of the roll stand and the unit of O-press after the U-can is conveyed into the proper position of the unit of O-press. In this FIG. 12, the guide rolls disposed in the unit of O-press 7 are utilized as the closing rolls 3.

At the time that the front end of the U-can 1 being conveyed into the unit of the O-press 7 reaches where the closing rolls are disposed at the entrance portion of the unit of O-press 7, the relevant closing rolls 3 are mobilized in the squeezing direction to squeeze the U-can again to narrow the U-can width. Thus, while the closing rolls 3 disposed at the entrance portion of the O-press squeeze the U-can 1 in succession, the closing rolls 3, conveyor rolls 2 and guide rolls are activated to convey the U-can 1 further into the unit of O-press 7.

Figure 13:
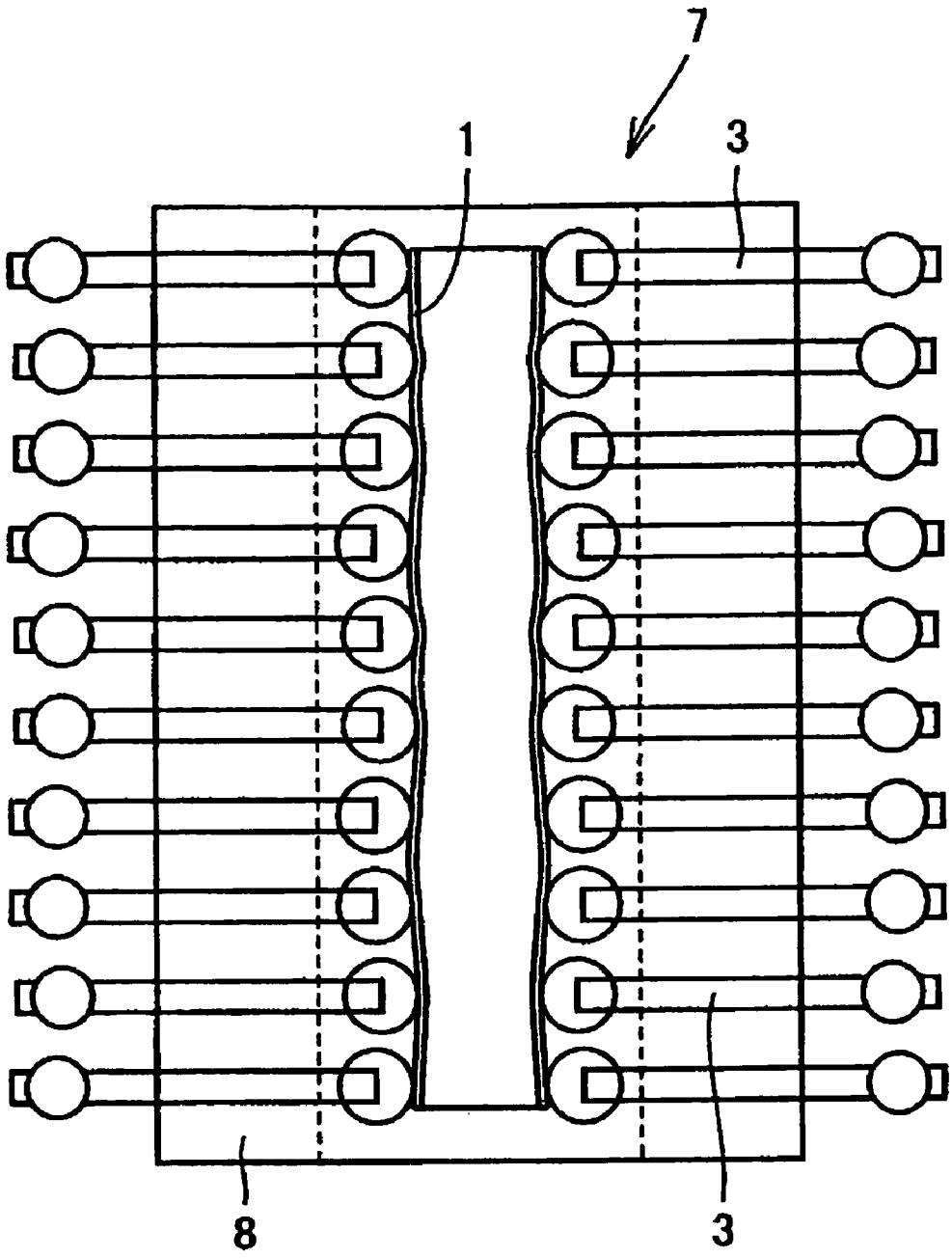
FIG. 13 is a plan view of the configuration of the state that the U-can is completely conveyed into the proper position within the unit of O-press.

FIG. 13 is a plan view of the configuration of the state that the U-can is completely charged into the proper position of the unit of O-press. After completion of charging the U-can 1, all of closing rolls 3 or guide rolls are retreated from the space confined by an upper and lower dies 8, and all of conveyor rolls 2 are kept as being moved down, so that the O-ing press of the U-can 1 is carried out.

Figure 14:
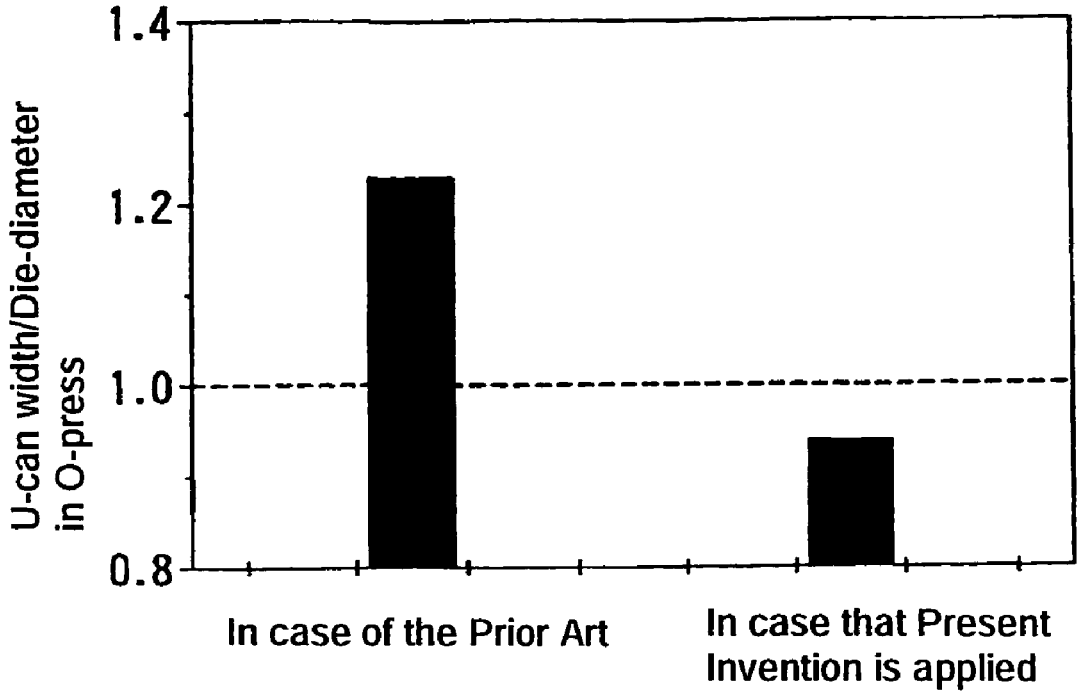
FIG. 14 is a diagram showing the results (U-can width/Die-diameter of O-press) where the effects of the present invention are confirmed.

FIG. 14 is a diagram showing the results (U-can width/Die-diameter of O-press) where the merits of the present invention are confirmed. The tested material has the yield strength of 700 N/mm$^2$, and the steel pipe of 32 inch in outside diameter×16 mm in wall thickness is chosen. In applying the present invention, the stroke of the closing rolls is set to 140 mm, which is determined by the foregoing precise investigation results.

In the case that the present invention is not applied, the U-can width becomes larger than the die-diameter of the O-press, or more than 1.2 times the die-diameter, thus making it impossible to convey the U-can into the proper position within the unit of O-press. In contrast, in the case that the present invention is applied, the U-can width becomes smaller than the die-diameter of the O-press, or 0.95 times the die-diameter, which does not cause any problem in conveying the U-can into the proper position within the unit of O-press.

Further, as the test material, the ultra high-strength steel of the yield strength above 800 $N/mm^2$ can be employed for applying the present invention.

INDUSTRIAL APPLICABILITY

The method and device for manufacturing UOE steel pipes according to the present invention, even in the case that the UOE steel pipes corresponding to X80 grade specified in API Standard are manufactured, can improve the U-can width, that is generated after U-ing press, so as to convey the U-can into the proper position within the unit of O-press without interfering with the dies, thus enabling UOE steel pipes for use in high-strength line pipes to be efficiently manufactured.

Hence, it becomes possible to properly cope with a demand for high-strength line pipes, and to be applied for manufacturing UOE steel pipes with a variety of wall thickness along with outside diameter for high-strength, thereby enabling the relevant method and device to be widely utilized.

What is claimed is:

1. A method for manufacturing UOE steel pipes comprising:

forming a U-can by a U-press;

narrowing an opening width of the U-can using closing rolls disposed upstream of an O-press, wherein the closing rolls are moved horizontally in a width narrowing direction and simultaneously conveying the U-can into an O-press; and subjecting the narrowed U-can to an O-ing press to yield an O-can.

2. A method for manufacturing UOE steel comprising:

forming a U-can by a U-press;

narrowing an opening width of the U-can using closing rolls disposed at least at an entrance portion of an O-press, wherein the closing rolls are moved horizontally in a width narrowing direction and simultaneously conveying the U-can into a proper position with the O-press; and subjecting the narrowed U-can to an O-ing press to yield an O-can.

3. A method for manufacturing UOE steel pipes comprising:

forming a U-can by a U-press;

narrowing an opening width of the U-can using closing rolls disposed upstream and at least at an entrance portion of an O-press, wherein the closing rolls are moved horizontally in a width narrowing direction and simultaneously conveying the U-can into a proper position with the O-press; and subjecting the narrowed U-can to an O-ing press to yield an O-can.

4. A device for manufacturing UOE steel pipes to be used in a manufacturing method wherein an O-can is formed using an O-press on a U-can formed from a U-press comprising:

a U-press for forming a U-can;

closing rolls movable horizontally in a width-narrowing direction and being disposed upstream of an O-press for narrowing an opening width of said U-can to be smaller than a die-diameter of said O-press; and an O-press for containing and O-ing the U-can, whose opening width is narrowed over its entire length, to yield an O-can.

5. A device for manufacturing UOE steel pipes to be used in a manufacturing method wherein an O-can is formed using an O-press on a U-can formed from a U-press comprising:

a U-press for forming a U-can;

closing rolls movable horizontally in a width-narrowing direction being disposed at least at an entrance portion of said O-press for narrowing an opening width of said U-can to be smaller than a die-diameter of said O-press; and an O-press for containing and O-ing the U-can, whose opening width is narrowed over its entire length, to yield an O-can.

6. A device for manufacturing UOE steel pipes to be used in the manufacturing method wherein an O-can is formed using an O-press on a U-can formed from a U-press comprising:

a U-press for forming a U-can;

closing rolls movable horizontally in a width-narrowing direction and being disposed upstream of an O-press as well as at least at the entrance portion thereof for narrowing the opening width of said U-can to be smaller than the die-diameter of said O-press; and an O-press for containing and O-ing the U-can, whose opening width of is narrowed over its entire length, to yield an O-can.

7. A device for manufacturing UOE steel pipes according to claim 4, wherein said closing rolls are disposed in a roll stand and configured to comprise multiple pairs.

8. A device for manufacturing UOE steel pipes according to claim 7, wherein a preventive mechanism is provided for preventing the U-can from moving upward, which takes place when said closing rolls narrow the opening width of the U-can.

9. A device for manufacturing UOE steel pipes according to claim 7, wherein said closing rolls have a function of conveying the U-can.

10. A device for manufacturing UOE steel pipes according to claim 8, wherein said closing rolls have a function of conveying the U-can.

11. A device for manufacturing UOE steel pipes according to claim 5, wherein said closing rolls are disposed in a roll stand and configured to comprise multiple pairs.

12. A device for manufacturing UOE steel pipes according to claim 6, wherein said closing rolls are disposed in a roll stand and configured to comprise multiple pairs.

* * * * *